United States Patent [19]

Kozey

[11] Patent Number: 4,973,403

[45] Date of Patent: Nov. 27, 1990

[54] SUCTION HEAD AND STRAINER ASSEMBLY

[76] Inventor: Gregory P. Kozey, Kozey Rd., Box 357, Eastford, Conn. 06242

[21] Appl. No.: 361,995

[22] Filed: Jun. 6, 1989

[51] Int. Cl.[5] ..... B01D 29/15

[52] U.S. Cl. ..... 210/170; 169/13; 169/30; 210/232; 210/242.1; 210/460; 405/61

[58] Field of Search ..... 210/416.1, 448, 449, 210/460, 170, 459, 232; 169/16, 13, 30; 405/61

[56] References Cited

U.S. PATENT DOCUMENTS

| | | | |
|---|---|---|---|
| 857,519 | 6/1907 | Foster | 210/460 |
| 1,070,788 | 8/1913 | Elliott | 210/460 |
| 2,957,579 | 10/1960 | McCombie | 210/460 |
| 3,037,636 | 6/1962 | McFarlin | 210/460 |
| 3,109,812 | 2/1961 | McAulay et al. | 210/460 |
| 3,782,552 | 1/1974 | Wendell | 210/460 |
| 4,179,379 | 12/1979 | Mitchell | 210/460 |
| 4,310,423 | 1/1982 | Brown et al. | 210/460 |
| 4,357,238 | 11/1982 | Ziaylek, Jr. | 210/460 |

*Primary Examiner*—Frank Spear
*Assistant Examiner*—Joseph Drodge
*Attorney, Agent, or Firm*—McCormick, Paulding & Huber

[57] ABSTRACT

A suction head and strainer assembly comprises a strainer portion of elongated hollow generally cylindrical configuration with a plurality of strainer holes at a closed end thereof. The strainer holes provide for an aggregate open area of approximately three times the cross sectional area of a fire hose attached to the assembly with openings being approximately one half inch in diameter and arranged in staggered rows of seventeen openings each. A discharge end portion of the assembly is connected to and communicates with the strainer portion and in turn connects with a fire hose at a suction end of the latter. A stop means is adjustable along the length of the strainer portion for selective positioning of the strainer holes beneath the surface of ice of varying thickness.

11 Claims, 2 Drawing Sheets

SUCTION HEAD AND STRAINER ASSEMBLY

BACKGROUND OF THE INVENTION

Surface ice on ponds, lakes, streams and swimming pools presents an obvious problem for firemen under emergency conditions and without a convenient fire hydrant. It is a conventional practice to chop a hole through the ice of substantial size and to thereafter throw a floating suction head and strainer device onto the surface of the exposed water. The floating suction head and strainer device may for example be of the type shown and described in U.S. Pat. No. 4,647,374 issued to Michael P. Ziaylek et al and entitled Floating Intake Head for Water Hoses.

As will be apparent, significant time may be expended in chopping a hole of substantial size especially when the ice is of significant thickness.

It is the general object of the present invention to provide a suction head and strainer assembly which can be inserted through a relatively small opening in surface ice and which is of desirably simple construction and yet highly efficient in operation.

SUMMARY OF THE INVENTION

In fulfillment of the foregoing general object, a suction head and strainer assembly for connection with fire hose and the like for drawing water upwardly through an opening in surface ice comprises an elongated hollow generally cylindrical strainer portion. The diameter of the strainer portion is at least approximately equal to that of an associated fire hose and the strainer portion has a length of at least twenty inches. One end of the strainer portion of the assembly is closed and an opposite end thereof is open. A plurality of closely spaced strainer holes are provided adjacent the closed end and extend therefrom along the length of the strainer portion over less than one half thereof. The strainer holes are approximately one half inch in diameter and are arranged in staggered rows extending in radial planes around the strainer portion with the holes in adjacent rows approximately one quarter of an inch apart. The aggregate area of the strainer holes may be approximately three times that of the cross sectional area of a fire hose connected with a suction and a strainer assembly. The holes are preferably arranged in nine (9) staggered rows With approximately 17 holes in each row.

A discharge end portion of generally hollow, cylindrical construction also has a diameter at least approximately equal to that of an associated fire hose and has an open end connected with and in fluid flow communication with said strainer portion. The strainer and discharge end portions are arranged with their longitudinal centerlines at least at an angle of 45° and preferably at an angle of approximately 90°. An opposite end of the discharge end portion is adapted for detachable connection with a fire hose or the like for fluid flow communication therewith.

Operatively associated with the strainer portion of the suction head and strainer assembly is an adjustable stop means which is disposed intermediate the ends of the strainer portion for limiting the downward movement of the assembly when the strainer portion is arranged operatively in a vertical attitude and entered downwardly in an opening in surface ice with the discharge end portion of the assembly connected to a fire hose for drawing water from beneath the ice. The adjustable stop means preferably comprises at least one laterally projecting stop arm and an associated clamping band around an intermediate portion of the strainer portion of the assembly. The clamping band has an associated manually operable means for selectively clamping and releasing the band at predetermined positions along the strainer portion. In the presently preferred form, the adjustable stop means comprises a pair of laterally projecting stop arm associated with the clamping band and manual operable means.

DESCRIPTION OF PREFERRED EMBODIMENT

Figure 2:
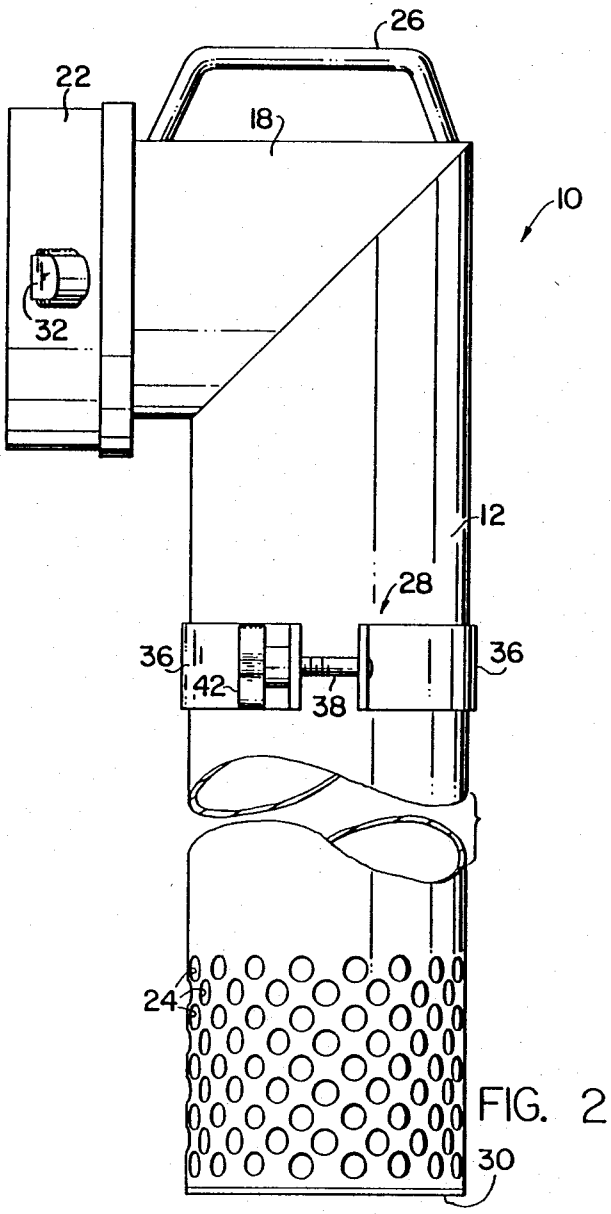
FIG. 2 is an enlarged side view of the suction head and strainer assembly of FIG. 1.
Figure 1:
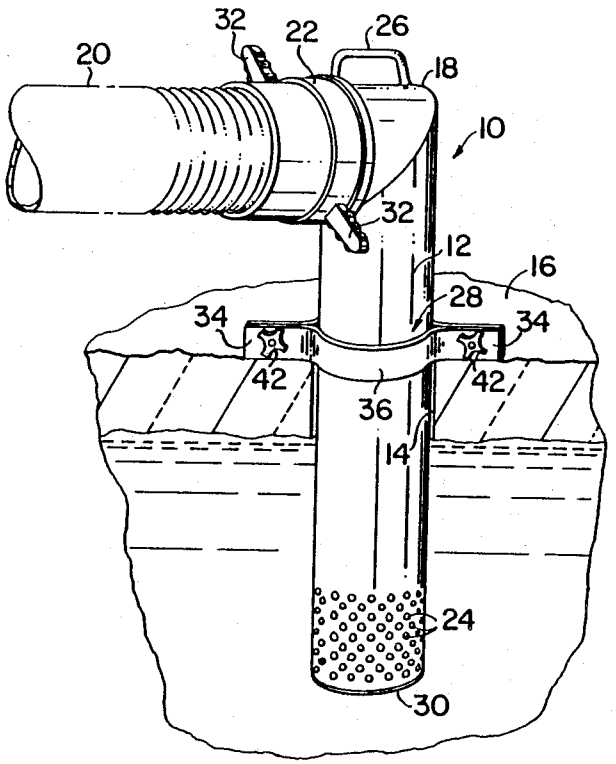
FIG. 1 of the drawings is a perspective view of a suction head and strainer assembly constructed in accordance with the present invention and illustrated in an operative position in an opening in surface ice on a pond, stream etc.

Referring particularly to FIG. 1, a suction head and strainer assembly indicated generally at 10 is shown in an operative position with a strainer portion 12 in a vertical attitude and entered downwardly in an opening 14 in surface ice 16 on the top of a pond, lake, stream, swimming pool etc. The suction head and strainer assembly 10 also includes a discharge end portion 18 connected with and in fluid communication with the strainer portion 12 and adapted at a left hand and open end portion thereof for connection with a fire hose 20. The fire hose 20 is shown as being of the spiral type but its construction may of course vary within the score of the invention. A quick connect coupling 22 is provided at the end of fire hose 20 and may be threaded internally for connection with an externally threaded end portion of the discharge end 18 of the suction head and strainer assembly. As will be apparent, water can be drawn through openings 24, 24 at a lower end portion of the strainer portion 12 upwardly through the strainer portion and thence horizontally through the discharge end portion 18 and the hose 20 by a suitable pump at an opposite end of the hose 20.

The opening 14 in the surface ice 16 is shown as being only slightly larger than the diameter of the strainer portion 12 of the suction head and strainer assembly and may be made, for example, by a power driven augur. Thus, the suction head and strainer assembly may be carried by a convenient handle 26 and merely dropped into the opening 14 which can be produced very rapidly and which will then tend to support the suction head and strainer assembly 10 in the position and attitude shown. The downward entry of the strainer portion 12 through the opening 14 is limited by a stop means 28 which will be described more fully hereinbelow.

Reverting now to the strainer portion 12, it will be observed that the said portion takes the form of an elongated hollow generally cylindrical member having a diameter at least approximately equal to that of the associated fire hose 20. The lower end portion thereof at 30 is preferably closed and imperforate so as to prevent the upward suction of debris from the bottom of a pond, lake, pool etc. An upper end portion thereof is open for connection with the discharge portion 18.

Preferably the length of the strainer portion 12 is at least 20 inches and as shown is approximately two and one half feet from the bottom to the centerline of the discharge end portion 18. The strainer holes 24, 24 are provided adjacent the closed end 30 and extend therefrom upwardly along the length of the strainer portion over less than one half of the length and, as shown, the upward extent of the openings is only about five inches. Preferably, the aggregate open area of the strainer holes 24, 24 is in the neighborhood of three times the cross sectional area of the fire hose 20 but this relationship may of course vary. As shown, each of the openings 24 is approximately one half inch in diameter with the holes arranged in staggered rows extending in radial planes around the strainer portion 12. The holes in adjacent rows are less than one half inch apart and are preferably approximately a quarter inch apart. While the number and placement of holes may of course vary in each row there are nine (9) staggered rows shown with approximately 17 openings in each row. The arrangement shown and described provides excellent results with the water being drawn into and upwardly through the strainer portion 20 and with undesirable debris etc. blocked by the strainer.

The discharge end portion 18 of the suction head and strainer assembly 10 is also preferably of a diameter at least approximately equal to that of the associated fire hose 20. Further, the said portion is preferably of a hollow generally cylindrical construction with opposite ends open and with one end connected with and in fluid flow communication with an upper end portion of the strainer 12. The opposite end of the discharge end portion 18 is connected with the hose 20 and the collar 22 as mentioned above. Preferably, the collar 22 is of the type which is manually operable with arms 32, 32 which may be gripped for rapid connection and disconnection of the hose from the discharge end portion of the suction head and strainer assembly.

In accordance with the invention, the strainer portion 12 and the discharge portion 18 are arranged with their longitudinal centerlines at least at an angle of 45° relative to each other and, preferably, the said two portions of the assembly are arranged at 90° as illustrated.

Figure 4:
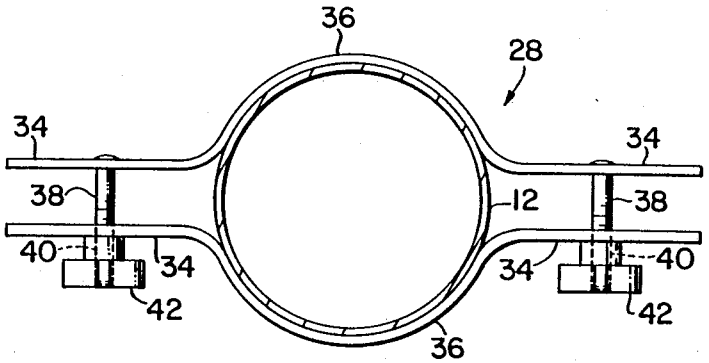
FIG. 4 is a horizontal sectional view taken approximately as illustrated at 4, 4 in FIG. 3
Figure 3:
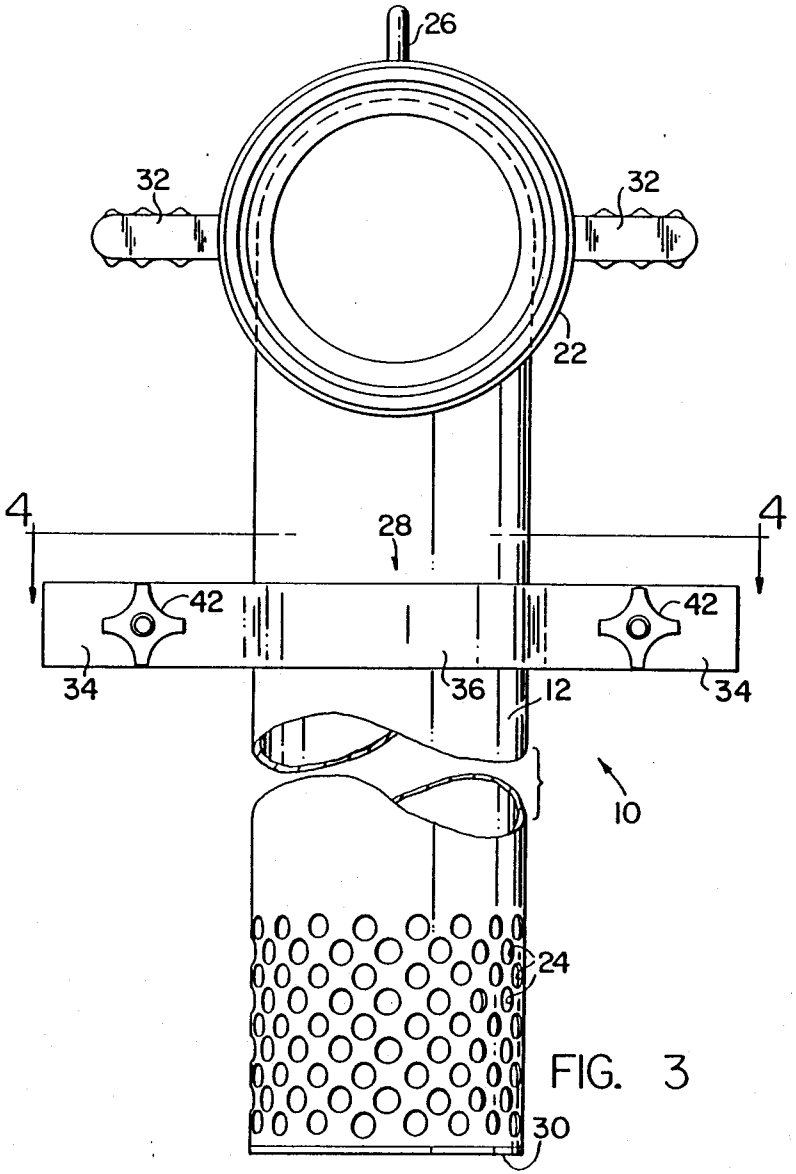
FIG. 3 is an enlarged front view of the suction head and strainer assembly.

The adjustable stop means 28 may of course vary in form but is shown as comprising at least one laterally projecting stop arm and an associated clamping band around an intermediate portion of strainer portion of the assembly. More specifically two (2) stop arms 34, 34 are provided and are associated with a two-part clamping band having semi-circular sections 36, 36 as best illustrated in FIG. 4. The semi-circular sections 36, 36 are disposed around the strainer portion 12 of the assembly and each arm 34, 34 is bifurcated and has an associated manually operable means for selectively clamping and releasing the band at predetermined positions along the strainer portion. That is, bolts 38, 38 pass through the arms 34, 34 with a threaded engagement being provided for at 40 and a manually manipulable knob at 42. On manual manipulation of the knob 42, 42 the bolts 38, 38 may of course be rotated to selectively clamp and release the stop means for adjustment to a desired position along the strainer portion 12.

As will be apparent from the foregoing, the suction head and strainer assembly of the present invention is of a desirable simple construction and under emergency conditions exhibits highly desirable operational characteristics. That is, a small circular opening 14 may be provided in surface ice such as 16 in an extremely rapid operation with a power driven augur. The hose 20 may be attached to the discharge end 18 of the assembly during drilling of the hole and immediately upon completion of the hole the lower end portion of the strainer portion 20 may be entered downwardly through the hole with operation of the pump commencing simultaneously for the supply of water to the fire truck and thence to the fire. Debris free operation is provided for with the necessary adjustments for depth of ice etc. on movement of the stop means 28 to selected positions along the strainer portions 12. The device is durable in operation and highly efficient in all respects.

I claim:

1. A suction head and strainer assembly for connection with fire hoses and the like for drawing water upwardly through an opening in ice formed on the surface of a lake, pond etc.; said assembly comprising an elongated hollow generally cylindrical strainer portion having a diameter at least approximately equal to that of an associated fire hose and a length of at least twenty inches so as to be entered vertically downwardly through an opening in surface ice and project substantially therebeneath, said strainer portion having a closed lower end and an opposite open end and a plurality of closely spaced strainer holes adjacent said closed end and extending therefrom along the length of the strainer portion over less than one half of said length, a discharge end portion of hollow generally cylindrical construction having a diameter at least approximately equal to that of an associated fire hose and with one end open and connected with an din fluid flow communication with said open end of said strainer portion, said strainer and discharge end portions of said assembly having their longitudinal centerlines arranged at an angle of at least 45°, and said discharge end portion having an end opposite its said one end adapted for quick detachable connection with a fire hose or the like in fluid flow communication with the latter, and an adjustable stop means disposed intermediate the ends of said strainer portion and in substantially spaced relationship with said strainer holes, said stop means serving to limit the downward movement of said assembly when said strainer portion is arranged operatively in a vertical attitude and entered downwardly in an opening in surface ice with said discharge end portion connected to a fire hose for drawing water from beneath the ice, and said stop means also serving to positively position the strainer holes beneath the surface of the water under the ice.

2. A suction head and strainer assembly as set forth in claim 1 wherein said adjustable stop means comprises at least one laterally projecting stop arm and an associated clamping band around an intermediate portion of said strainer portion of the assembly, said clamping band having an associated manually operable means for selectively clamping and releasing the band at predetermined positions along said strainer portion.

3. A suction head and strainer assembly as set forth in claim 2 wherein said stop means includes a pair of laterally projecting stop arms associated with said clamping band and manual means.

4. A suction head and strainer assembly as set forth in claim 1 wherein said strainer holes are circular and approximately one half inch in diameter.

5. A suction head and strainer assembly as set forth in claim 4 wherein said strainer holes are arranged in staggered rows extending in radial planes around the strainer portion with the holes in adjacent rows less than one half inch apart.

6. A suction head and strainer assembly as set forth in claim 5 wherein the spacing between said holes in adjacent rows is approximately one quarter of an inch.

7. A suction head and strainer assembly as set forth in claim 6 wherein the aggregate area of the strainer holes is approximately three times that of the cross sectional area of a fire hose connected with the suction head and strainer assembly.

8. A suction head and strainer assembly as set forth in claim 7 wherein the strainer holes are arranged in nine (9) staggered rows.

9. A suction head and strainer assembly as set forth in claim 8 wherein approximately seventeen strainer holes are provided in each row of holes.

10. A suction head and strainer assembly as set forth in claim 1 wherein the closed end of said strainer portion of said assembly is imperforate.

11. A suction head and strainer assembly as set forth in claim 1 wherein said strainer portion and said discharge end portion of said suction head and strainer assembly are arranged approximately at 90° with respect to each other.

* * * * *

UNITED STATES PATENT AND TRADEMARK OFFICE

CERTIFICATE OF CORRECTION

PATENT NO. : 4,973,403

DATED : November 27, 1990

INVENTOR(S) : Gregory P. Kozey

It is certified that error appears in the above-identified patent and that said Letters Patent is hereby corrected as shown below:

Claim 1, column 4, line 32, "an din" should be --and in--.

Claim 5, column 5, lines 1 and 2, starts single spaced and ends in double space.

Claims 6 and 7, column 5, lines 5-15, double spaced, should be single spaced.

Signed and Sealed this

Sixteenth Day of June, 1992

*Attest:*

DOUGLAS B. COMER

*Attesting Officer*

*Acting Commissioner of Patents and Trademarks*